US005087939A

United States Patent [19]

McDougal

[11] Patent Number: 5,087,939

[45] Date of Patent: Feb. 11, 1992

[54] IMAGE FORMING APPARATUS AND IMAGE MEMBER CARTRIDGE

[75] Inventor: David R. McDougal, Fairport, N.Y.

[73] Assignee: Eastman Kodak Company, Rochester, N.Y.

[21] Appl. No.: 650,260

[22] Filed: Feb. 4, 1991

[51] Int. Cl.[5] ..... G03G 15/00

[52] U.S. Cl. ..... 355/200; 355/210; 355/271

[58] Field of Search ..... 346/160.1, 157; 355/200, 210, 211, 277, 326, 327, 271

[56] References Cited

U.S. PATENT DOCUMENTS

| | | | |
|---|---|---|---|
| 4,068,937 | 1/1978 | Willemse et al. . | |
| 4,453,820 | 6/1984 | Suzuki | 355/279 |
| 4,591,258 | 5/1986 | Neshino et al. | 355/200 |
| 4,712,906 | 12/1987 | Bothner et al. | 355/271 |
| 4,821,066 | 4/1989 | Foote et al. | 355/ |
| 4,876,577 | 10/1989 | Ogura et al. | 355/315 |
| 4,910,558 | 3/1990 | Glezeman et al. | 355/200 |
| 4,939,541 | 7/1990 | Sugiura | 355/202 |
| 4,994,853 | 2/1991 | Fukuchi et al. | 355/208 |
| 5,001,515 | 3/1991 | Nomura et al. | 355/200 |

*Primary Examiner*—A. T. Grimley
*Assistant Examiner*—Patrick J. Stanzione
*Attorney, Agent, or Firm*—Leonard W. Treash, Jr.

[57] ABSTRACT

An image forming apparatus includes an image member supplied to the apparatus in an image member cartridge and a transfer member which engages the image member through an access opening in the cartridge. The transfer member is driven by a motor in the image forming apparatus and in turn drives the image member in the cartridge, eliminating the need for a separate driving connection between the image forming apparatus and the image member.

21 Claims, 8 Drawing Sheets

IMAGE FORMING APPARATUS AND IMAGE MEMBER CARTRIDGE

RELATED APPLICATION

This application is related to co-assigned: U.S. patent application Ser. No. 07/650,259, filed Feb. 4, 1991, Rydelek et al, IMAGE FORMING APPARATUS HAVING A TRANSFER MEMBER AND A DRIVE THEREFOR. U.S. patent application Ser. No. 07/650,325, filed Feb. 4, 1991, DeCecca, IMAGE FORMING APPARATUS AND AN IMAGE MEMBER CARTRIDGE.

TECHNICAL FIELD

This invention relates to an image forming apparatus which uses a cartridge containing an image member on which transferable toner images are formed. It also relates to a cartridge containing such an image member which cartridge is insertable in an image forming apparatus.

BACKGROUND ART

U.S. Pat. No. 4,876,577, Ogura et al, issued Oct. 24, 1989, shows an electrophotographic apparatus which receives a cartridge containing a photoconductive drum. The cartridge includes both a charging mechanism for charging the drum and a cleaning mechanism for cleaning it. An access opening is provided for imagewise exposure of a charged surface of the drum to create an electrostatic image on the drum. The electrostatic image is toned through another access opening in the cartridge by one of two toning stations which are rotatable into position opposite the access opening to create a toner image. The toner image is transferred to a receiving sheet fed through a receiving sheet opening into contact with the drum. The receiving sheet is separated from the drum by a special mechanism which is part of the cartridge and fed outside of the cartridge to a fusing device.

U.S. Pat. No. 4,591,258, to Nishino et al, issued May 27, 1986, shows a cartridge containing a rotatable photoconductive drum with charging, cleaning and development stations also within the cartridge. An access opening to the drum permits transfer of toner images to a receiving sheet fed into engagement with the drum. Rotation of the drum is accomplished by a driving connection at the end of the cartridge which must mate with a drive member in the receiving apparatus. Projections are provided on the cartridge to prevent damage to the cartridge driving connection member from careless handling.

Many other references show such image member cartridges, and they are used commercially in personal copiers and laser printers. In general, the photoconductive drum is driven by an end connection to the drum through an end of the cartridge. Mounting of the cartridge in the image forming apparatus requires assuring that the drive connection is effectively made.

U.S. Pat. No. 4,712,906, to Bothner et al, issued Dec. 15, 1987, shows a transfer drum for a color printer. In one embodiment, a series of different color toner images are transferred to a receiving sheet carried by the drum which rotates to repeatably present the receiving sheet to an image member. In another embodiment, the different color toner images are transferred directly to the outside surface of a transfer drum to create a multicolor image on the transfer drum which is subsequently transferred in a single step to a receiving sheet at a position remote from the image member. Other references show an intermediate transfer member in the form of an endless web rather than a drum; see for example, U.S. Pat. No. 4,453,820, Suzuki, issued Jun. 12, 1984.

U.S. Pat. No. 4,821,066, Foote et al, issued Apr. 11, 1989 shows a color printer having a photoconductive web movable through an endless path. A transfer drum controls superposition of color toner images and drives the web through its endless path. Use of the transfer drum to drive the web provides uniformity to the drive and other advantages in a system previously driven by a support roller.

DISCLOSURE OF THE INVENTION

It is the object of the invention to simplify a cartridge containing an image member upon which a toner image is formable.

This and other objects are accomplished by an image forming apparatus which includes means for receiving a cartridge containing an image member. The apparatus includes a transfer member which engages the image member, directly or through a receiving sheet, to transfer toner images from the image member. The transfer member is driven by appropriate drive means in the apparatus. The transfer member in turn drives the image member through engagement with it.

With this invention, the image member need not have a separate driving connection to the apparatus, for example, at the end of the cartridge. This greatly simplifies the construction of the cartridge and its insertion in the image forming apparatus. Driving of the image member is accomplished instead by a component also used in toner image transfer.

Thus, the above object is also accomplished by a cartridge having an image member movable past a series of stations by engagement with a transfer member through an access opening in the cartridge.

This invention is particularly usable in a color image forming apparatus. In such apparatus, a transfer member, such as a transfer drum, engages an image member, directly or through a receiving sheet, to superpose a series of single color toner images to form a multicolor toner image.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

Figure 1:
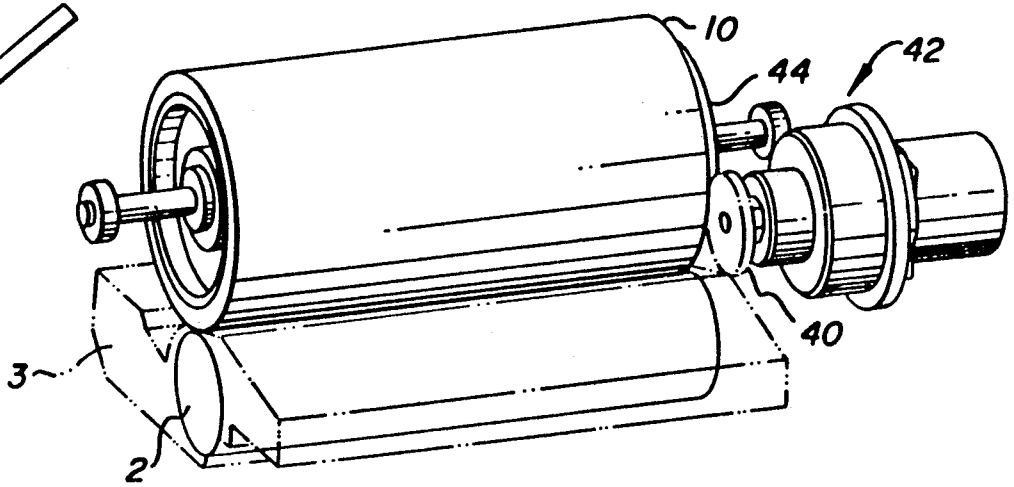
FIG. 1 is a perspective schematic of an image forming apparatus with housing and other support parts eliminated for clarity of illustration.

An image forming apparatus, for example, a printer 1, is shown in FIG. 1 with housing and support structures eliminated for clarity of illustration. Printer 1 includes an image member, for example, a photoconductive drum 2 which is rotatable through a series of stations for forming a series of toner images of different colors. Photoconductive drum 2 has a cylindrical image surface which is first charged by a charging station 4 and then imagewise exposed by a laser 5 to create a series of electrostatic images. The electrostatic images are toned by toners of different color by a movable development device 6 which includes 3 or 4 separate development units. Each unit applies a different color toner to one of the series of electrostatic images to create a series of different color toner images on the cylindrical image surface of drum 2. The series of different color toner images are transferred in registration to a transfer surface associated with a transfer drum 10 to create a multicolor color image on that surface. As shown in FIG. 1, the surface to which the toner images are transferred is a cylindrical peripheral surface of drum 10 itself. However, the toner images could also be transferred to a receiving sheet held on the surface of drum 10 as is well known in the art.

The multicolor image is transferred by a transfer station 21 to a receiving sheet fed from a receiving sheet supply 45. The receiving sheet is then transported to a fuser 23 where the multicolor image is fixed and then to an output hopper 44 through an inverting path.

After transfer of the multicolor image from the surface of drum 10 to the receiving sheet, the transfer surface of the transfer drum 10 is cleaned by an articulating cleaner 30 so that it may receive a new set of images. The photoconductive drum 2 is cleaned continuously during image formation by a cleaning device 12.

As will be shown in later FIGS., the photoconductive drum 2 is supplied to the printer 1 in a cartridge which cartridge may also contain other portions of printer 1. For example, the cartridge may contain the charging device 4, the developing device 6 and/or cleaning devices 30 and 12.

Figure 3:
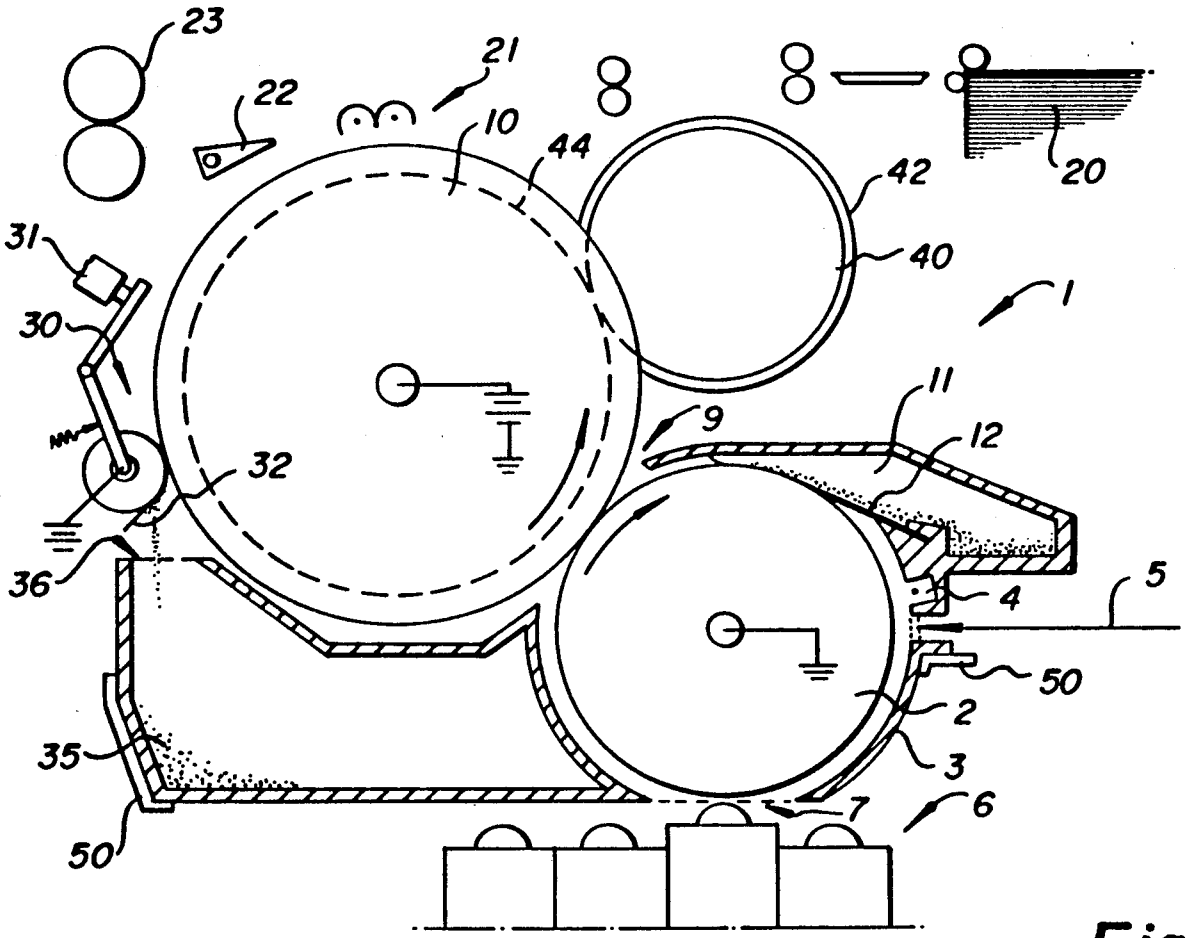
FIG. 3 is a front schematic of the image forming apparatus shown in FIG. 1 with portions of an image member cartridge shown in cross section for clarity of illustration.

One example of such a cartridge is shown in FIG. 3 in which the cartridge housing is shown in section while the rest of the apparatus is shown schematically. According to FIG. 3, a cartridge housing 3 contains image member 2, an opening for exposure by laser 5, charging device 4 and image member cleaning device 12. It also includes a sump 11 for receiving toner cleaned by cleaning device 12 off image member 2 and a sump 35 for receiving toner cleaned off transfer drum 10 by transfer drum cleaner 30. Housing 3 also includes an opening 7 providing access to image member 2 for development device 6 and an opening 9 providing access to image member 2 for transfer drum 10.

Articulating cleaner 30 is moved in and out of engagement with transfer drum 10 by a solenoid 31. It includes a cleaning roller which rolls on the surface of transfer drum 10 which roller is biased and formed of a material which encourages removal of toner to the roller. Cleaned toner is scrapped off the roller by a scraping blade 32. An opening 36 in cartridge housing 3 receives scraped toner into sump 35.

A receiving sheet is fed from a receiving sheet supply 20 into transfer relation with transfer drum 10. In the structure shown in FIG. 3, transfer is accomplished by a corona transfer station 21, known in the art. The transfer sheet is picked off transfer drum 10 by a movable pick-off 22 which also directs the transfer sheet to fuser 23.

Figure 2:
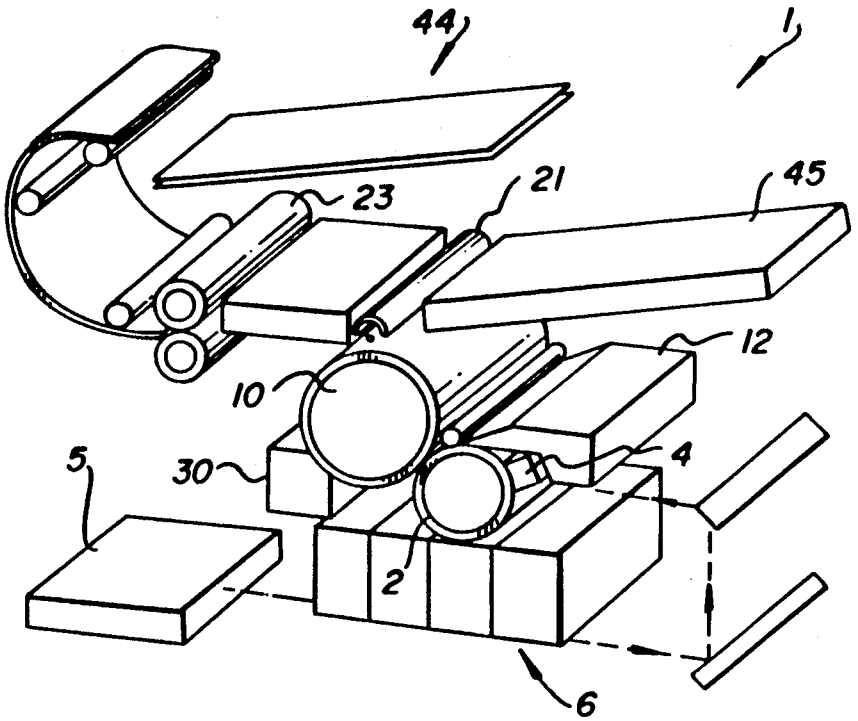
FIG. 2 is a perspective view illustrating the drive train of an image forming apparatus with some parts in phantom and other parts eliminated for clarity of illustration.

Prior cartridges which contained image members such as photoconductive drum 2 included a relatively complex drive connector at one end of the cartridge which must be engaged with an appropriate drive in the receiving apparatus to rotate drum 2 past the toner image forming stations. As shown in FIGS. 2 and 3, the need for such a drive connector is eliminated. A motor 42 drives a drive gear 40 which in turn drives a gear 44 connected to transfer drum 10. Transfer drum 10 is made up of material somewhat softer than photoconductive drum 2, for example, polyurethane. Photoconductive drum 2 engages transfer drum 2 through opening 9 and is frictionally driven by transfer drum 10 for its entire operation. Thus, opening 9 provides access to image member 2 for both transfer and for frictional, driving engagement with transfer drum 10. With this structure, no separate drive connection needs to be made between transfer drum 2 and the receiving apparatus. This greatly simplifies the manufacture of the cartridge and its cost as well as loading of the cartridge 3 in the printer 1. FIG. 2 is a perspective drawing illustrating the drive train from motor 42 through transfer drum 10 and photoconductive drum 2.

The term "engagement" as used herein with reference to the image member and the transfer member is preferably direct contacting engagement of those members. However, although not preferred, it can also be engagement through a receiving sheet carried by the transfer member.

Although transfer drum 10 is shown with an external drive engagement between transfer drum 10 and motor 42, motor 42 could be positioned inside transfer drum 10 and internally engaged with drum 10 to save space in printer 1. This latter embodiment is shown in FIG. 15.

Figure 15:
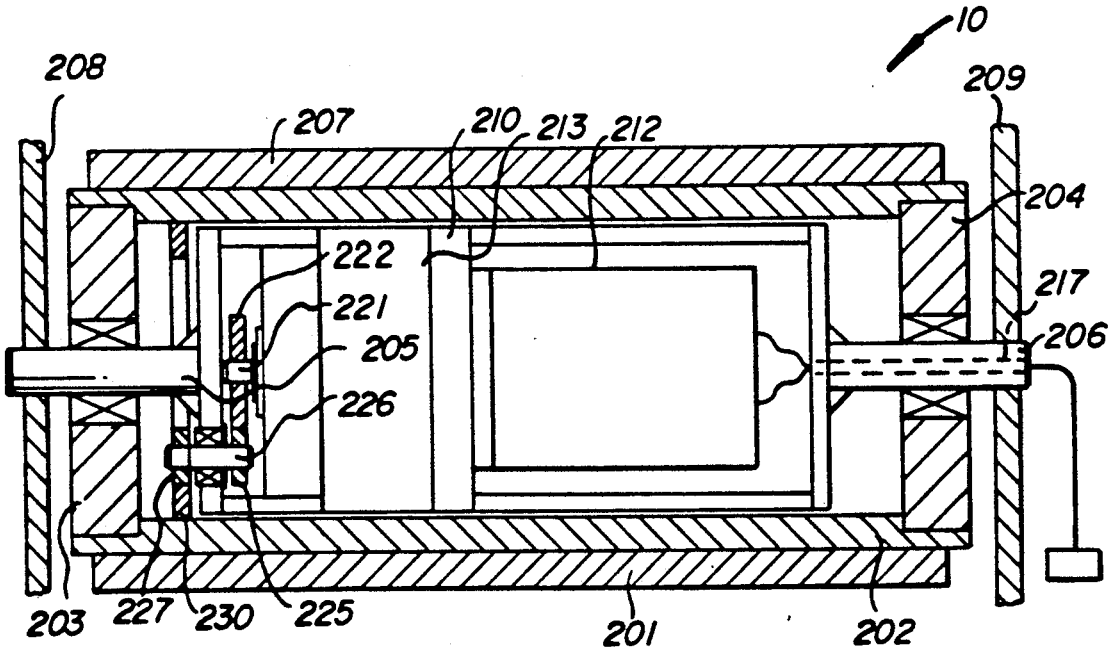
FIG. 15 is a top of a transfer drum illustrating an alternative drive mechanism for the apparatus shown in FIG. 1.

According to FIG. 15, transfer drum 10 includes an outer layer 201 of polyurethane cast or otherwise formed on an aluminum or steel base 202. Layer 201 defines a cylindrical transfer surface 207 to which several single color toner images are transferred directly to form a multicolor image. A pair of gudgeons 203 and 204 support base 202 and are journaled for rotation about fixed shafts 205 and 206.

Shafts 205 and 206 rotate about different portions of a single axis of rotation and are considered a single shaft for all purposes herein. Shafts 205 and 206 are fixed in mechanism plates 208 and 209 of the printer, and support an internal drive housing 210 located inside transfer drum 10. Internal drive housing 210 includes a motor 212 and planetary gear box 213. The planetary gear box provides a suitable gear reduction between the motor and an output shaft 221. A drive gear 222 is fixed on output shaft 221 and is rotated by output shaft 221 to drive a first idler gear 225. First idler gear 225 is fixed to an idler shaft 226 journaled for rotation with respect to drive housing 210. A second idler gear 227 is also fixed to and is rotated by idler shaft 226. Second idler gear 227 engages an internal gear 230 fixed to the inside of drum base 202 to rotate drum 10 with respect to shafts 205 and 206 and housing 210. A hole 217 in the center of shaft 206 provides an exit for wiring the motor 212.

With the structure shown in FIG. 15, transfer drum 10 comes to printer 1 with its own internal drive. That drive does not need to be separately mounted in the printer, saving a step in printer final assembly. More importantly, the drive does not take up space in the printer, allowing the printer to be more compact.

The structure shown in FIG. 15 is particularly useful to drive a transfer drum 10 which receives toner images directly to its surface and then transfers them to a receiving sheet, because such a drum does not require a vacuum source or other structure for holding a receiving sheet to the drum surface, thereby leaving the room necessary for the transfer drum drive housing 210. It is also particularly useful with a cartridge loading image member 2 as shown in FIGS. 2-5 which image member is driven by transfer drum 10, since, with such a structure, no usable space is taken up in printer 1 for a drive for either of drums 10 or 2.

Although driving the image member 2 utilizing peripheral engagement with transfer drum 10 through access opening 9 greatly simplifies cartridge 3, some precision in the placement of cartridge 3 is important in this apparatus. In the structure shown in FIG. 3, cartridge 3 is shown supported by receiving mechanism 50 which positions the cartridge so that sufficient engagement between drum 2 and drum 10 is obtained to both transfer images and drive drum 2. For best image quality, it is necessary to control both the size of the nip between the drums and to maintain the axes of rotation of the drums parallel. To do this with the FIG. 3 construction is feasible for modest image quality. However, for highest image quality, tolerances in the manufacture of cartridge 3, receiving structure 50 and the location of drum 10 become confining. Accordingly, more precise positioning mechanisms are shown in FIGS. 4-14.

Figure 4:
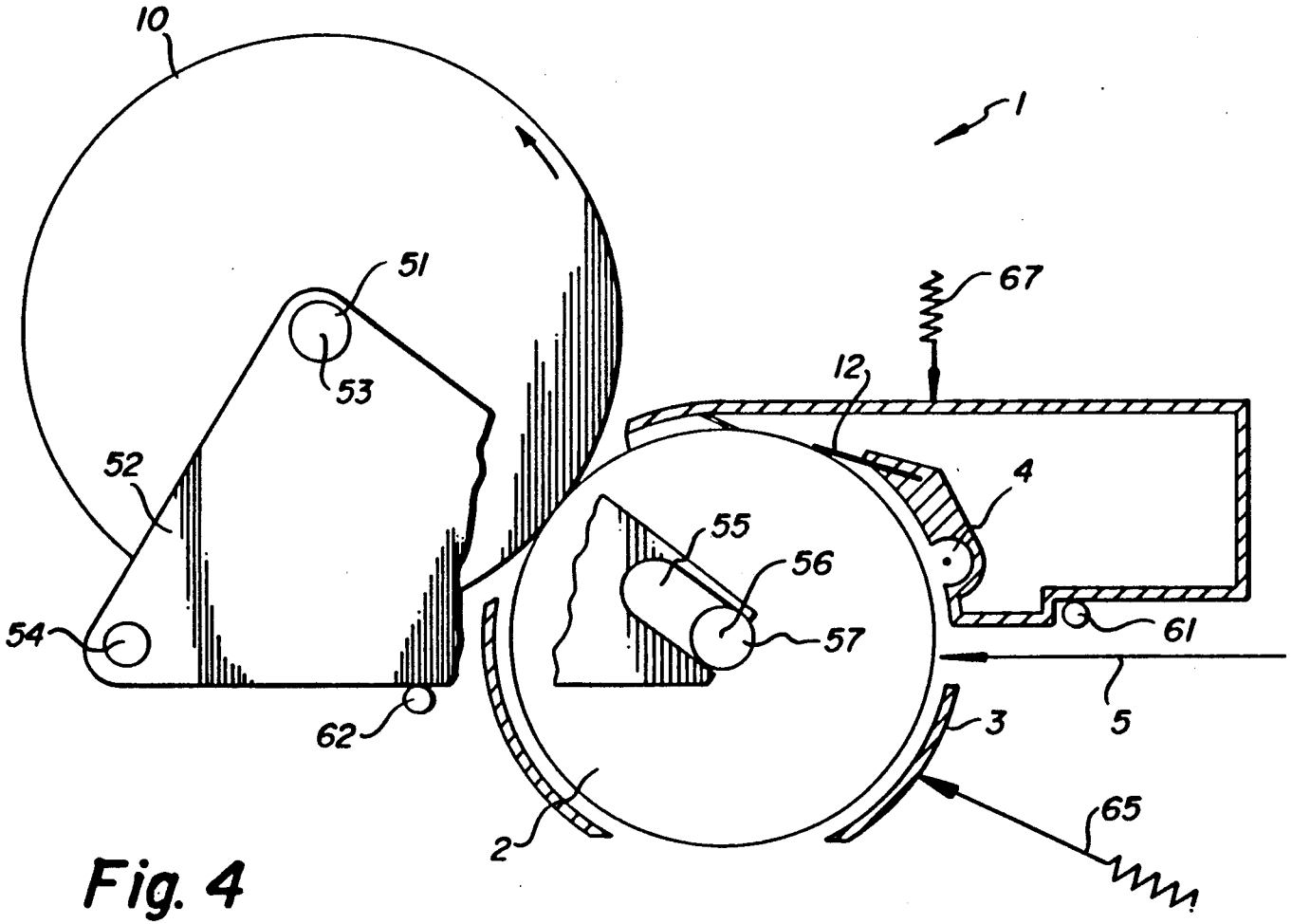
FIG. 4 is a front schematic of the drive train and cartridge portions of an alternative image forming apparatus with portions eliminated and broken away for clarity of illustration.
Figure 5:
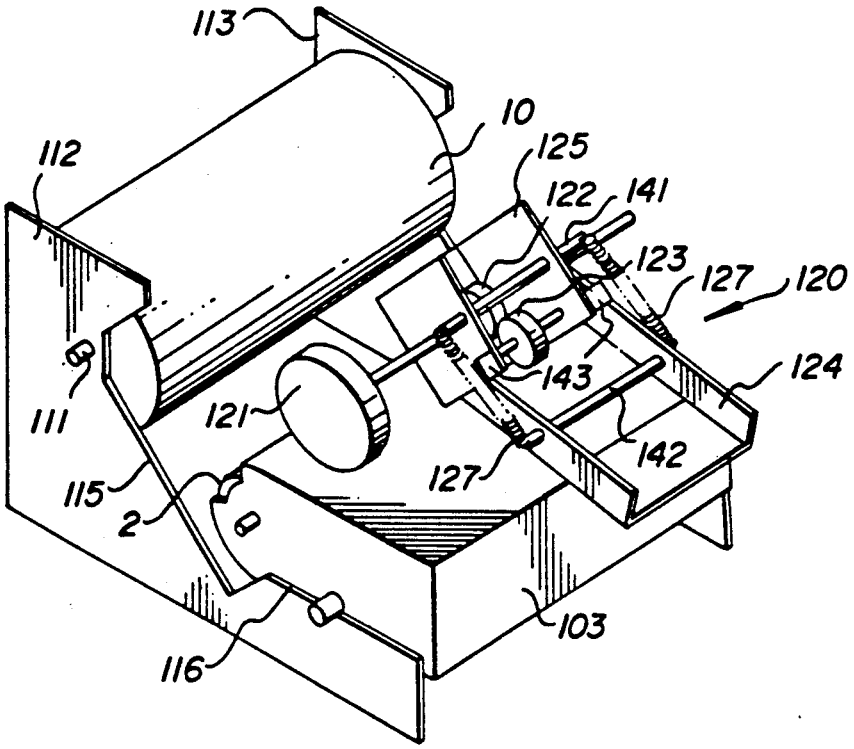
FIG. 5 is a perspective view of a cartridge and a mounting structure portion of an alternative image forming apparatus.

According to FIG. 4, cartridge 3 includes drum 2, charging station 4 and cleaning device 12, but does not include a sump for receiving toner 15 cleaned from drum 10. Transfer drum 10 is supported on a shaft 51 which, in turn, is supported by a pair of mechanism plates of the apparatus, for example, mechanism plates 208 and 209, shown in FIG. 15. Also supported on shaft 51 are a pair of triangularly shaped plates 52 at opposite ends of drum 10. Plates 52 are also connected by an auxiliary shaft 54 and are generally rotatable about shaft 51 but rigidly fixed with respect to each other.

Photoconductive drum 2 is supported for rotation about an axis 56 by a shaft 57 which shaft extends beyond the end walls of cartridge 3. Drum 2 rotates with respect to shaft 57, so shaft 57 is fixed with respect to cartridge 3. A slot 55 in each of triangular plates 52 is shaped to receive snugly the ends of shaft 57.

To load cartridge 3 in the embodiment shown in FIG. 4, plates 52 can be rotated to a position slightly counterclockwise from that shown in FIG. 4 to receive shaft 57 into slots 55. Plates 52, transfer drum 10 and cartridge 3 are then rotated clockwise around shaft 51 until plates 52 rest on a stop 62 which is a permanent portion of printer 1. The cartridge 3 can still be rotated about shaft 57 until a portion of cartridge 3 rests on another stop 61 which is also a permanent part of printer 1.

Slots 55 in plates 52 are parallel with each other and define control surfaces which maintain a parallel relation between the axes of rotation of drums 10 and 2. Stops 61 and 62 generally orient the cartridge in printer 1 for access to the exposing and developing devices 5 and 6 (FIGS. 1 and 3). The nip between drums 10 and 2 is controlled by a spring 65 which urges cartridge 3 toward transfer drum 10 and the image surface of drum 2 into engagement with the transfer surface associated with drum 10. A spring 67 may also be used to maintain the contact between cartridge 3 and stop 61, thereby preventing rotation of the cartridge around shaft 57. Spring 67 may not in fact be necessary, since the rotation of transfer drum 10 will also urge cartridge 3 against stop 61. However, spring 67 can be part of an upper part of printer 1 which, after the insertion of cartridge 3 is closed onto a lower part, which lower part holds motor 42, transfer drum 10, laser 5, development device 6 and associated support structure. Spring 65, although part of the lower portion of the apparatus, can also be tensioned and/or applied to cartridge 3 as part of this closing operation.

FIGS. 5-12 show another approach to positioning an image member cartridge in an image forming apparatus similar to that shown in FIG. 1. According to FIG. 5, a cartridge 103 containing an image member 2 is to be loaded into an apparatus which includes a transfer drum 10 with the axes of rotation of drums 2 and 10 sufficiently parallel to avoid image degradation during transfer of high quality images, which images must be registered with great accuracy to form a quality multicolor image.

Transfer drum 10 is supported on a shaft 111, which, in turn, is supported by front and rear guide plates 112 and 113, respectively. Shaft 111, of course, may be in two sections as are shafts 205 and 206 shown in FIG. 15. Guide plates 112 and 113 extend substantially to the right from transfer drum 10 and each include control surfaces 115 and support surfaces 116 which cooperate with portions of cartridge 103.

Figure 7:
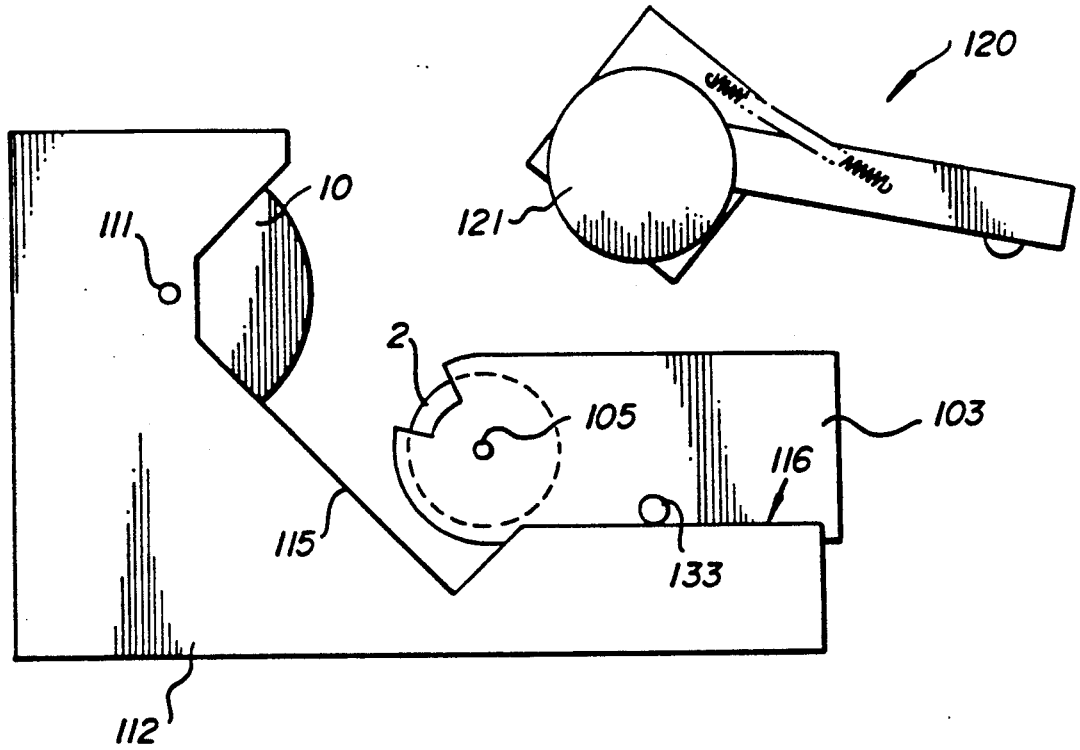
FIGS. 7 and 8 are front views of the structure in FIG. 5 in its partially loaded and fully loaded conditions, respectively.
Figure 8:
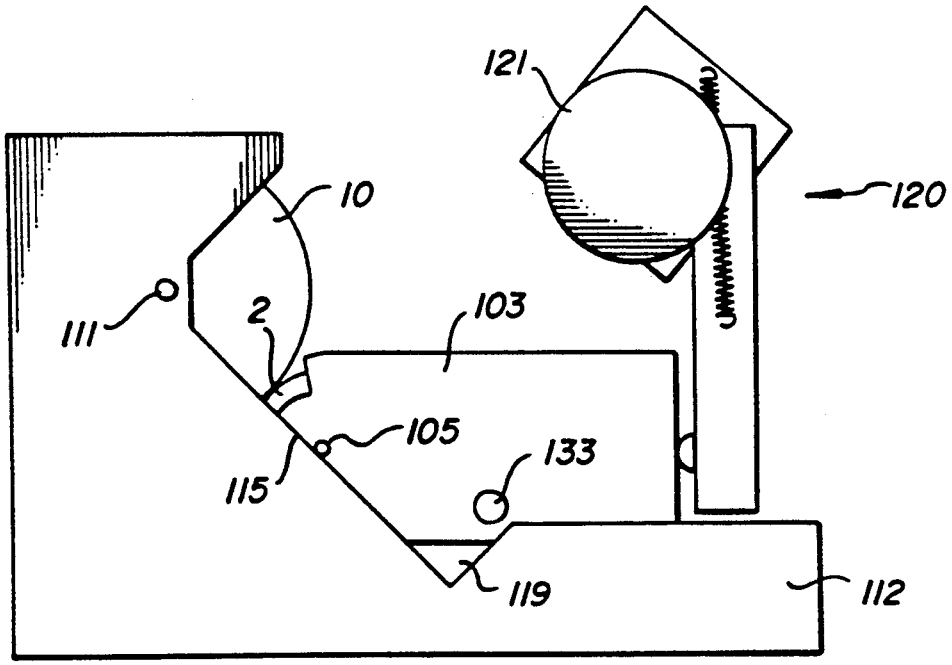
Figure 9:
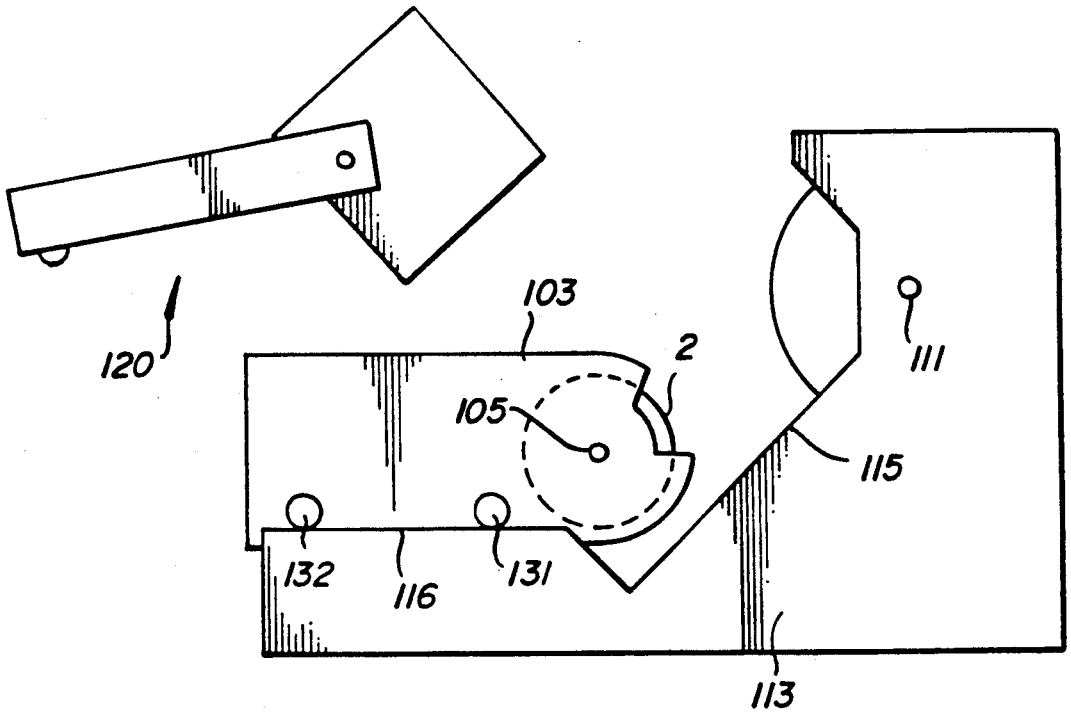
FIGS. 9 and 10 are rear views of the structure shown in FIGS. 7 and 8 also in its partially loaded and fully loaded conditions, respectively.
Figure 10:
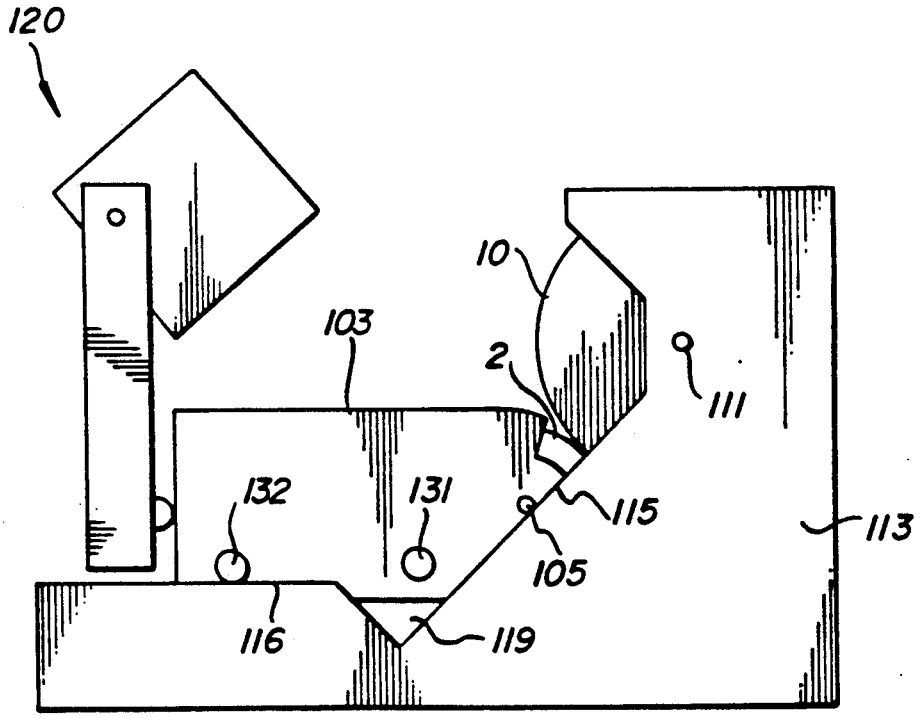

As best seen in FIGS. 7-10, an over-center spring mechanism 120 is actuated to drive cartridge 103 from an unloaded condition shown in FIGS. 7 and 9 to a fully loaded condition shown in FIGS. 8 and 10.

Cartridge 103 is positioned in the apparatus by the operator resting left and right rear support bosses 131 and 132, respectively, on rear support surface 116 as shown in FIG. 9, a single front support boss 133 on front guide surface 116, with all three support bosses thus resting on support surfaces 116. Support surfaces 116 are generally horizontal.

Drum 2 is mounted in cartridge 103 on a support shaft 105 (which also may be in two sections as shown in FIG. 15), and rotates about an axis at the center of the shaft. Over-center spring 120 is actuated (as described below) to push cartridge 103 to the left as shown in FIG. 8. This action pushes shaft 105 into contact with control surfaces 115 of guide plates 112 and 113. Control surfaces 115 are parallel with each other. Their projection is generally tangent to transfer drum shaft 111. As seen in FIGS. 8 and 10, over-center spring 120 pushes cartridge 103 until shaft 105 rides up control surfaces 115 until drum 2 engages transfer drum 10. A notch 119 in guide plates 112 and 113 causes cartridge 103 to no longer be supported by bosses 131 and 133.

Thus, in its fully loaded condition shown in FIGS. 8 and 10, with drum 2 engaging drum 10, cartridge 103 is supported only by the ends of shaft 105 riding up parallel control surfaces 115 and by boss 132 resting on support surface 116. This three-point contact forces shaft 105 to always contact both control surfaces 115. Thus, to the extent that the peripheral surfaces of drums 2 and 10 are cylindrical and accurately mounted on shafts 105 and 111, and the location of control surfaces 115 are accurate, the axes of drums 2 and 10 will be parallel.

The extent of the parallelness between the axes is a determining factor on the image quality in transfer. If, for example, the support boss 133 were allowed to continue to contact guide surface 116, it would be possible for either end of shaft 105 to become out of contact with its control surface 115, thereby losing parallelness between the axes of rotation of the drums. This might be overcome by preciseness in the manufacture of the housing of cartridge 103 and bosses 132 and 133. However, with the structure shown in FIGS. 5–12, the only items required to be precise in the cartridge are the drum 2 and its support shaft 105. In the receiving apparatus, control surfaces 115 also must be accurately positioned with respect to shaft 111 and shaft 111 must be accurately positioned with respect to transfer drum 10.

Figure 11:
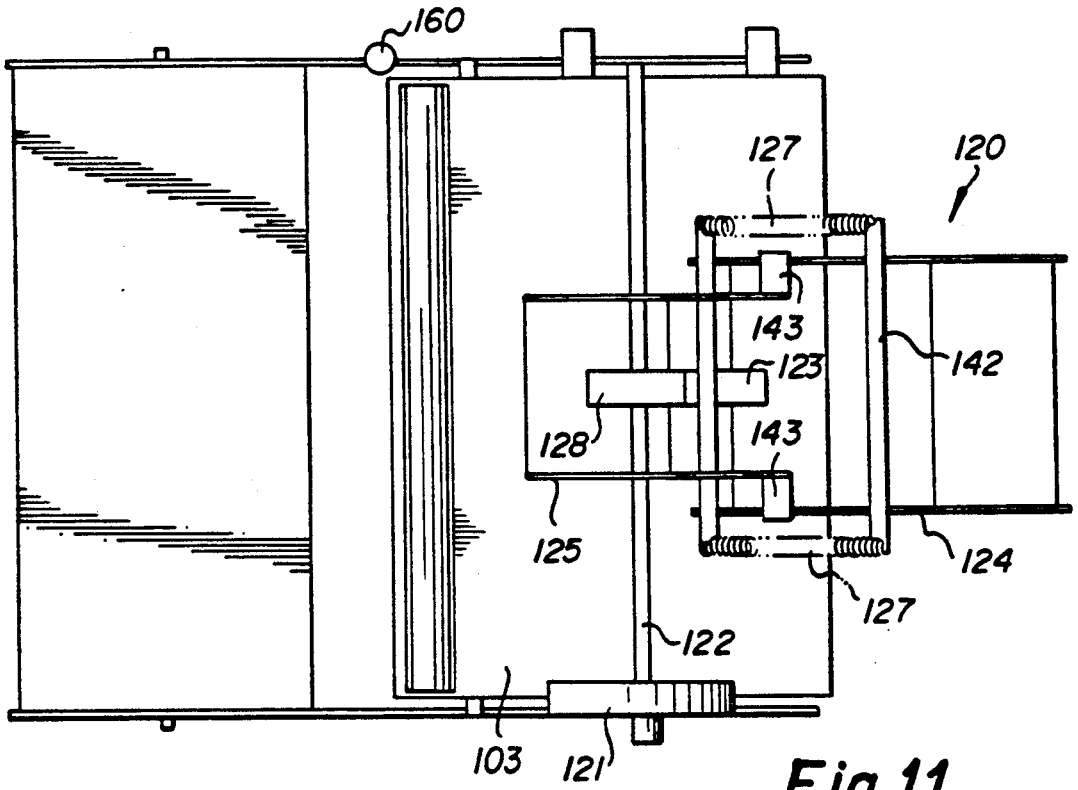
FIGS. 11 and 12 are top views of the structure shown in FIGS. 5–10 in its partially loaded and fully loaded conditions, respectively.
Figure 12:
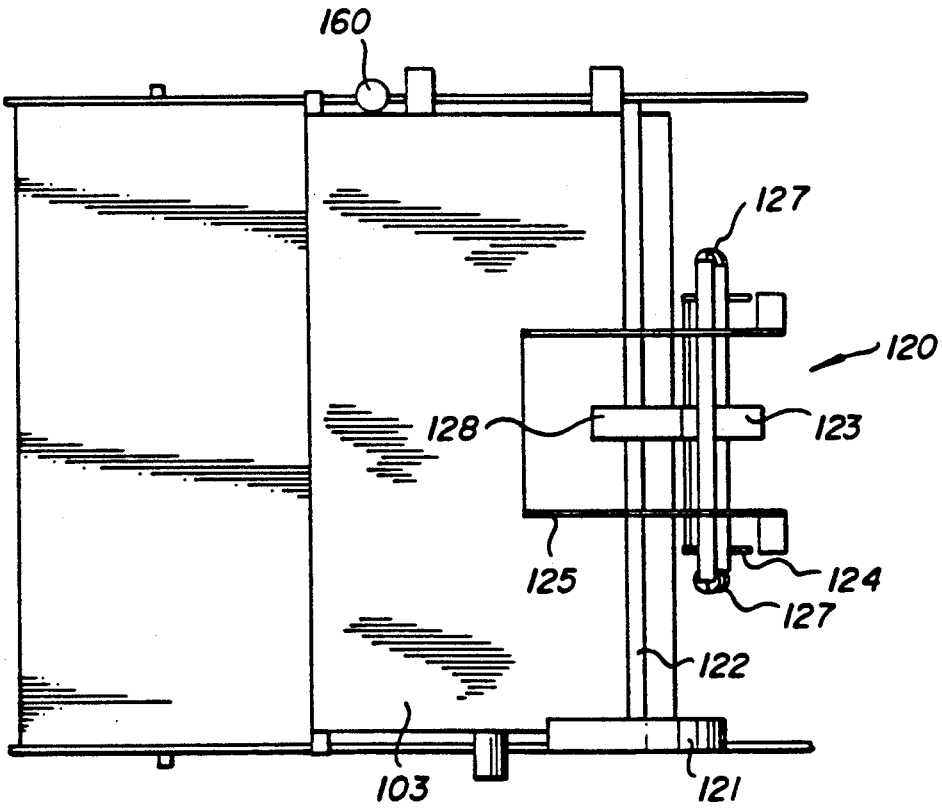

A roller 160 is shown in FIGS. 11 and 12, and is part of a structure to prevent movement of cartridge 103 to the rear. A complementary roller or spring to the front of the path of cartridge 103 is not shown.

It also may be desirable to urge the top of the cartridge gently in a downward direction during operation to prevent engagement of the drums from unseating it. This can be accomplished with a spring applied as part of closing the apparatus after loading of cartridge 103.

Cartridge 103 can be pushed to the left (as seen in FIG. 8) by any appropriate spring mechanism. However, FIGS. 6, 11 and 12 illustrate an over-center spring mechanism 120 which is particularly useful for this function.

Figure 6:
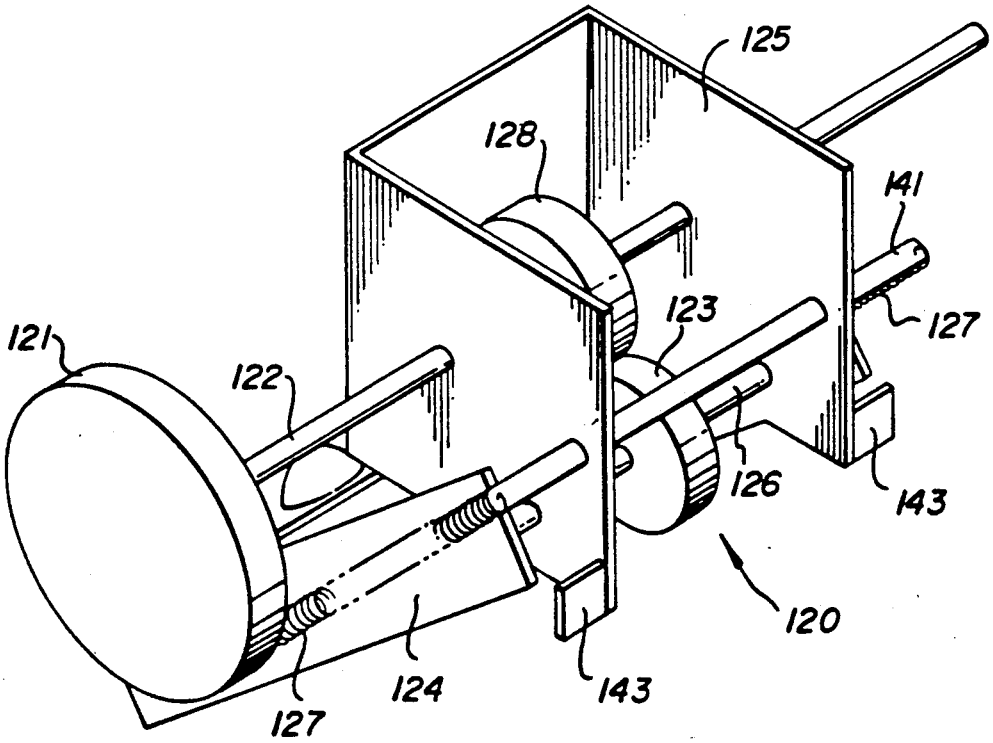
FIG. 6 is a perspective view of an over-center spring mechanism forming a part of the apparatus shown in FIG. 5.

As best seen in FIGS. 5, 6, 11 and 12, a support housing 125 is attached to printer 1 by suitable means, not shown, and supports the rest of over-center spring mechanism 120. Referring to FIG. 6, a customer actuated knob 121 is rotated by the person inserting cartridge 103. Knob 121 is keyed through a shaft 122 to a drive roller or gear 128. Rotation of knob 121 rotates drive roller 128 which in turn rotates a driven roller 123. Driven roller 123 is keyed to a lever 124 through a shaft 126. Thus, rotation of knob 121 rotates lever 124 around shaft 126. Lever 124 pushes cartridge 103 into its loaded condition and holds it there with the desired force urging engagement of drums 2 and 10.

A pair of springs 127 are mounted between a spring support 141 on housing 125 and a spring support rod 142 (FIG. 5) on lever 124. Shaft 126 is between the attaching positions of springs 127. Thus, springs 127 have a dead-center position between latched and unlatched conditions of lever 124 where the shaft 126 lines up with the attaching positions. That is, as knob 121 is rotated in a counterclockwise direction as seen in FIG. 6, lever 124 is driven in a clockwise direction toward a latching position urging cartridge 103 to the left until photoconductive drum 2 engages transfer drum 10. In this movement, spring 127 goes through a "dead-center" position in which it is at its maximum length and therefore its maximum stressed condition. Further clockwise rotation of lever 124 causes springs 127 to urge lever 124 into engagement with cartridge 103 and cartridge 103 into its loaded condition as shown in FIG. 8. To unload cartridge 103, knob 121 is rotated in a clockwise direction to rotate lever 124 in a counterclockwise direction as seen in FIG. 6 until springs 127 pass through their dead center position. At this point, further rotation of knob 121 is aided by springs 127 urging lever 124 toward its totally unlatched position, shown in FIG. 5 with lever 124 resting against a pair of lever stops 143 where lever 124 will not interfere with removal of the cartridge. Thus, with the over-center spring structure 120, lever 124 is generally urged by springs 127 toward either a latched condition shown in FIGS. 6, 8, 10 and 12 or toward an unlatched condition shown in FIGS. 5, 7, 9 and 11.

Figure 13:
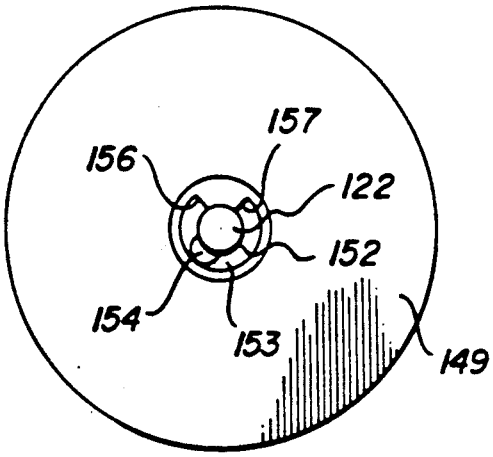
FIGS. 13 and 14 are front and rear views, respectively, of a circular disk which forms part of a knob 121 shown in FIGS. 5 and 6.
Figure 14:
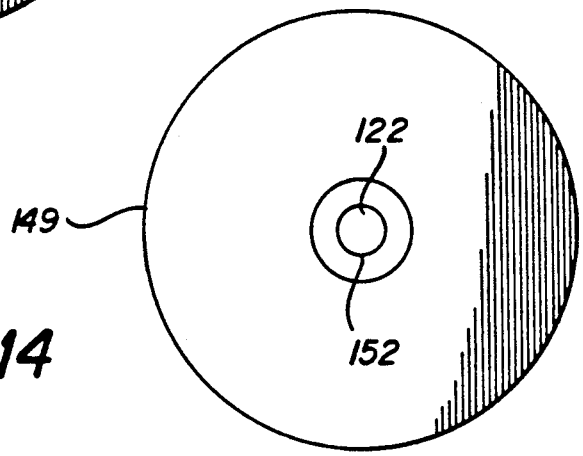

Knob 121 can be constructed so that the customer who is loading the cartridge does not, in fact, feel the final positioning of the cartridge in its loaded condition or the positioning of lever 124 against stops 143. Knob 121 includes a circular plate 149, the front and rear sides of which are shown in FIGS. 13 and 14, respectively. Drive shaft 122 is positioned in a hole 152 through plate 149. The front surface of plate 149 includes a groove 153 contiguous with the front portion of hole 152. Shaft 122 includes a protrusion 154 which rides in groove 153 except where not permitted by ends 156 and 157 of the groove 153.

In operation, knob 121 is turned in either direction until protrusion 154 engages one of groove ends 156 or 157. From that point on, rotation of knob 121 rotates shaft 122 until the "over-center" condition of springs 127 occurs. At this point, the spring accelerates the rotation of lever 124 in either a latching or unlatching direction causing the shaft 122 to rotate ahead of either groove end 156 or 157 until lever 124 reaches its fully latched or unlatched condition. This design has the advantage of fully positioning the lever 124 without the spring acceleration of lever 124 or its stopping being felt by the person rotating knob 121. It also discourages over rotation of lever 124 by the operator which can damage cartridge 103 or drums 2 or 10.

The positioning device shown in FIGS. 5–14 positions the photoconductive drum 2 against the transfer drum 10 with the axes of revolution of the two drums parallel. Precision is required in only the manufacture and assembly of shafts 111 and 105, drums 2 and 10 and guide surfaces 115. This parallelism is important to prevent image degradation in high-quality transfer. This makes it particularly usable in a multicolor printer providing high-quality multicolor images which are the result of superimposing a series of single color images. It is particularly usable when the photoconductive drum is driven by the transfer drum (as shown in FIGS. 1–4) because such driving engagement between the two drums requires a substantial nip which increases the degradation of the image if the axes are not parallel. However, it certainly can be used in structures in which the photoconductive drum 2 is driven by its own drive means and either drives the transfer drum or is driven independently of it.

Note that the manufacture and location of bosses 131, 132 and 133 are not critical to parallelism of the axes, nor is the manufacture of guide surfaces 116. Note also that guide surface 115 maintains parallelism of shafts 105 and 111. If the two shafts are the same size, surfaces 115 should be parallel with each other and their extensions should be tangent to the periphery of shaft 111. If shaft 111 is larger than shaft 105, extensions of guide surfaces 115 should intersect shaft 111 accordingly. Shaft 105 is preferably a stationary shaft with photoconductive drum 2 mounted for rotation with respect to it. This eliminates the necessity of making guide surfaces 115 bearing surfaces. Shaft 111 can rotate with transfer drum 10 or be stationary, with transfer drum 10 rotating with respect to it as shown in FIG. 15.

Shaft 105 could be rotatable with photoconductive drum 2. In such a design, it would be preferable to have shaft 105 supported for rotation in bearings, which bearings have a housing which contacts guide surfaces 115. Alternatively, if surfaces 115 are made of self-lubricating material, shaft 105 can rotate with drum 2 on surfaces 115.

Although each of the positioning structures shown herein has particular adaptability and is designed for a transfer drum 10 which receives toner images directly on its outer transfer surface, the structures can also be used with a transfer drum which supports a receiving sheet on its outer surface.

The invention has been described in detail with particular reference to a preferred embodiment thereof, but it will be understood that variations and modifications can be affected within the spirit and scope of the invention as described hereinabove and as defined in the appended claims.

I claim:

1. An image forming apparatus comprising:

a replaceable cartridge supporting an image member having an image surface, which image member is movable to bring said image surface past a series of stations for forming transferable images on said image surface, said cartridge having a transfer opening providing access to said image surface, a transfer member having associated therewith a transfer surface, said surface being engageable with said image surface through said transfer opening, said transfer surface being movable with said image surface for transfer of toner images, and means for moving said transfer member to move said transfer surface, said transfer surface in turn moving said image member to move said image surface past the series of stations.

2. An image forming apparatus comprising:

a replaceable cartridge containing a photoconductive drum having a peripheral image surface, said photoconductive drum being supported in said cartridge for rotation to move its image surface past a series of stations to form a series of different color toner images on said image surface, and said cartridge having means defining access to the image surface for transfer of said images in registration to a transfer surface to form a multicolor image, a transfer drum having associated therewith a transfer surface which transfer surface is frictionally engageable with the image surface of said photoconductive drum through said access defining means, and means for rotating said transfer drum to in turn rotate said photoconductive drum through the frictional engagement of said transfer and image surfaces.

3. An image forming apparatus according to claim 2 wherein said transfer surface is a cylindrical outer surface of said transfer drum.

4. An image forming apparatus according to claim 2 wherein said transfer surface is an outer surface of a receiving sheet secured to a cylindrical outer surface of said transfer drum.

5. An image forming apparatus according to claim 3 further including means for transferring a multicolor toner image from the transfer surface to a receiving sheet.

6. An image forming apparatus comprising:

a replaceable cartridge containing a drum-shaped image member having an image surface and means for supporting said image member for rotation about an image member axis, a series of stations, at least one of which is contained in said cartridge for forming a series of toner images on said image member as the peripheral surface of said image member rotates past said stations, means defining access through said cartridge to the peripheral surface of said image member for transfer of toner images to a transfer surface, a transfer drum located outside of said cartridge and having a cylindrical transfer surface which is engageable with the image surface of said image member through said access defining means, and means for rotating said transfer drum to in turn rotate said image member through engagement of said transfer surface and said image surface.

7. The image forming apparatus according to claim 6 further including means for transferring toner images in registration from said image surface to said transfer surface.

8. The image forming apparatus according to claim 7 wherein said means for forming toner images includes means for forming a series of different color toner images to create a multicolor toner image on said transfer surface.

9. The image forming apparatus according to claim 8 further including means for transferring said multicolor image to a receiving sheet from said transfer surface.

10. Image forming apparatus comprising:

a replaceable cartridge containing a photoconductive drum supported for rotation about an axis to bring said drum past a series of electrophotographic stations to form a series of different color toner images on said surface, said cartridge having means defining access to said photoconductive drum for transfer of said different color toner images in registration to a transfer surface to form a multicolor image, a transfer drum, having a cylindrical transfer surface which transfer surface is engageable with said photoconductive drum through said access defining means, and means for rotating said transfer drum to in turn rotate said photoconductive drum to transfer said different color toner images in registration to said transfer surface.

11. An image forming apparatus according to claim 10 further including means for transferring said multicolor image from said transfer surface to a receiving sheet.

12. An image forming apparatus according to claim 10 wherein at least one of said series of electrophotographic stations is positioned inside said cartridge.

13. An image forming apparatus according to claim 12 wherein said at least one station is a charging station.

14. An image forming apparatus according to claim 13 wherein said cartridge further includes a cleaning station where said photoconductive drum is cleaned, and an opening through which exposure light can pass to form electrostatic images on said photoconductive drum.

15. An image forming apparatus according to claim 12 wherein said cartridge further includes an opening through which said electrostatic images are tonable.

16. An image forming apparatus according to claim 15 further including means for applying a different color toner to each of said series of electrostatic images through said opening through which said electrostatic images are tonable.

17. An image member cartridge, comprising:

a cartridge housing, an image member supported for movement to create a toner image on said image member, and means defining an opening in said housing to said image member through which a toner image on said image member is transferable to a moving transfer surface and through which said image member is movable by engagement with a moving transfer surface.

18. An image member cartridge comprising:

a cartridge housing, an image member supported for rotation about an axis to move said image member past a series of stations at least one of which is located inside said cartridge to create a series of toner images on said image member, and means defining an opening to said image member through which a toner image is transferable from said image member to a moving surface and through which said image member is movable by engagement with such a moving surface.

19. An image member cartridge comprising:

a drum having a cylindrical image surface upon which a toner image is formable, a cartridge housing in which said drum is rotatable, and an opening in said housing through which said cylindrical image surface is accessible both for transfer of said toner image and for rotating said drum.

20. An image member cartridge comprising:

a housing, a photoconductive drum having a cylindrical image surface, said drum being mounted for rotation in said housing, means for uniformly charging said surface, an optical opening in said housing through which said surface is exposable to create a series of electrostatic images, an opening in said housing through which said electrostatic images are developable by application of toners of colors that are different from image to image to create a series of different color toner images, and an opening in said housing through which said toner images are transferable by contact with a moving transfer surface and through which said drum is rotatable by said moving transfer surface.

21. An image member cartridge, for use in an image forming apparatus which apparatus includes imagewise exposure means, development means, a rotatable transfer drum, means for rotating said transfer drum and means for receiving am image member cartridge, said cartridge being positionable in operative relation with such a receiving means and said cartridge comprising:

a rotatable drum-shaped image member, having a cylindrical outer image surface, charging means, a cartridge housing including means defining an exposure opening, means defining a development opening, and means defining a transfer opening, said drum-shaped image member being rotatable to bring said cylindrical image surface past said charging means for uniformly charging said image surface, past said exposure opening for imagewise exposing said charged image surface to create a series of electrostatic images, past said development opening for the application of different color toners to said series of electrostatic images to create different color toner images on said image surface and past said transfer opening for engagement with the rotatable transfer drum of an image forming apparatus for transfer of toner images in registration to said transfer drum to create a multicolor image and for rotation of said image member as a direct result of engagement between said image member and the transfer drum of the image forming apparatus.

* * * * *